US010495301B2

(12) United States Patent
Nonoyama

(10) Patent No.: US 10,495,301 B2
(45) Date of Patent: Dec. 3, 2019

(54) PREMIXING APPARATUS

(71) Applicant: RINNAI CORPORATION, Aichi (JP)

(72) Inventor: Masao Nonoyama, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 84 days.

(21) Appl. No.: 15/751,332

(22) PCT Filed: Jun. 23, 2016

(86) PCT No.: PCT/JP2016/003041
§ 371 (c)(1),
(2) Date: Feb. 8, 2018

(87) PCT Pub. No.: WO2017/033373
PCT Pub. Date: Mar. 2, 2017

(65) Prior Publication Data

US 2018/0231243 A1 Aug. 16, 2018

(30) Foreign Application Priority Data

Aug. 25, 2015 (JP) ..... 2015-165402

(51) Int. Cl.
*F23D 14/02* (2006.01)
*F23D 14/62* (2006.01)
(Continued)

(52) U.S. Cl.
CPC ..... *F23D 14/02* (2013.01); *F23D 14/34* (2013.01); *F23D 14/36* (2013.01); *F23D 14/62* (2013.01);
(Continued)

(58) Field of Classification Search
CPC .. F23N 1/02; F23D 14/60; F23D 14/62; F23L 13/06
(Continued)

(56) References Cited

U.S. PATENT DOCUMENTS 3,601,037 A * 8/1971 Giaretta ..... A47J 37/046 99/443 C
5,613,357 A * 3/1997 Mowill ..... F02C 9/50 60/39.23
(Continued)

FOREIGN PATENT DOCUMENTS

JP 60-2143 U 1/1985
JP 2001-235120 A 8/2001
(Continued)

OTHER PUBLICATIONS

International Search Report and Written Opinion for PCT Patent App. No. PCT/JP2016/003041 (dated Sep. 20, 2016) with English translation of the ISR.

*Primary Examiner* — Avinash A Savani
*Assistant Examiner* — Aaron H Heyamoto
(74) *Attorney, Agent, or Firm* — Cermak Nakajima & McGowan LLP; Tomoko Nakajima

(57) ABSTRACT

A premixing apparatus has: a fan; an air tube; and a gas tube inside the air tube; provided that a direction toward an air flow upstream side inside the air tube is defined as an X+ direction, an air adjusting valve facing an air inlet port positioned at an end, in the X+ direction, of the air tube; a gas adjusting valve facing a gas outlet port positioned at one end of the gas tube; and a common actuator driving the air adjusting valve and the gas adjusting valve. At an end, in the X− direction, of the gas tube, is disposed a valve seat having formed therein the gas outlet port, and a gas adjusting valve inside the gas tube. A valve stem penetrates through an end wall, in the X+ direction, of the gas tube. The gas adjusting valve is driven by the actuator through the valve stem.

2 Claims, 3 Drawing Sheets

(51) Int. Cl.

| | |
|---|---|
| ***F23N 1/02*** | (2006.01) |
| ***F23L 13/06*** | (2006.01) |
| ***F23D 14/36*** | (2006.01) |
| ***F23D 14/34*** | (2006.01) |
| ***F23L 13/00*** | (2006.01) |

(52) U.S. Cl.
CPC ..... *F23L 13/00* (2013.01); *F23L 13/06* (2013.01); *F23N 1/02* (2013.01); *F23N 1/025* (2013.01)

(58) Field of Classification Search
USPC ..... 431/12
See application file for complete search history.

(56) References Cited

U.S. PATENT DOCUMENTS

2002/0069645 A1* 6/2002 Mowill ..... F23R 3/26 60/776
2003/0013056 A1* 1/2003 Fredricks ..... F23D 14/60 431/90
2010/0330520 A1* 12/2010 Kanda ..... F23D 14/60 431/350
2013/0224670 A1* 8/2013 Zatti ..... F23D 14/02 431/38
2013/0260325 A1 10/2013 Min
2016/0061445 A1* 3/2016 Kim ..... F23N 1/02 431/354
2017/0284663 A1* 10/2017 Nonoyama ..... F23D 14/06
2017/0292697 A1* 10/2017 Shimazu ..... F23D 14/02

FOREIGN PATENT DOCUMENTS

JP 2014-502337 A 1/2014
JP 2014-215007 A 11/2014
JP 2014215007 A * 11/2014
JP 2015-014431 A 1/2015
JP 2018179447 A * 11/2018
WO WO-2012081796 A1 * 6/2012 ..... F23N 1/02

* cited by examiner

PREMIXING APPARATUS

This application is a national phase entry under 35 U.S.C. § 371 of PCT Patent Application No. PCT/JP2016/003041, filed on Jun. 23, 2016, which claims priority under 35 U.S.C. § 119 to Japanese Patent Application No. 2015-165402, filed Aug. 25, 2015, both of which are incorporated by reference.

TECHNICAL FIELD

The present invention relates to a premixing apparatus which mixes fuel gas with air, thereby supplying a burner with air-fuel mixture.

BACKGROUND ART

Conventionally, as this kind of premixing apparatus, there is known in a Patent Document 1 a premixing apparatus comprising a fan for supplying air, and an air tube which is disposed on an upstream side of the fan so that air flows therethrough. Suppose: that a longitudinal direction of the air tube is defined as an X-axis direction; that, in the X-axis direction, the direction looking toward an upstream side of air flow is defined as an X-axis plus direction; and that the direction looking toward a downstream side of the air flow is defined as an X-axis minus direction. The premixing apparatus further comprises: a bottomed gas tube which is connected to a downstream end of a gas supply passage for supplying the fuel gas, an end part, in the X-axis minus direction, disposed in the air tube being closed; an air adjusting valve lying opposite to an air inlet port which is positioned at an end part, in the X-axis plus direction, of the air tube, in a manner to be movable back and forth in the X-axis direction to thereby vary an opening degree of the air inlet port; a gas adjusting valve lying opposite to a gas outlet port which is positioned at an end part, in the X-axis plus direction, of the gas tube, in a manner to be movable back and forth in the X-axis direction to thereby vary an opening degree of the gas outlet port; and a common actuator which drives in the X-axis direction the air adjusting valve and the gas adjusting valve.

It is to be noted here that the gas supply passage has generally interposed therein a zero governor which maintains the secondary gas pressure at atmospheric pressure. In this case, the fuel gas supply amount varies with the differential pressure between the atmospheric pressure that is the secondary pressure and the suction negative pressure of the fan. Then, since the suction negative pressure of the fan varies with the number of fan revolution, the fuel gas supply amount will vary with the number of fan revolution, that is, the air supply amount. Therefore, by controlling the number of fan revolution according to the required combustion amount, the amount of the air and the fuel gas according to the required combustion amount is understood to be supplied to the burner.

However, once the number of fan revolution has fallen below the lower-limit number of revolution at which the number of fan revolution can maintain the proportional characteristics of the air supply amount, it will no longer be possible to supply the amount of the air and the fuel gas according to the required combustion amount. Therefore, in the above-mentioned apparatus of the conventional example, in a region in which the required combustion amount falls below the predetermined value corresponding to the lower-limit value of the number of fan revolution, the opening degrees of the air inlet port and the gas outlet port are adjusted by the air adjusting valve and the gas adjusting valve in a state in which the number of fan revolution is maintained at the lower-limit number of revolution. The air and the fuel gas can thus be arranged to be supplied according to the required combustion amount below the predetermined value.

By the way, there is an example in which the gas supply passage has interposed therein a proportional valve in place of a zero governor. In this case, the air tube may be disposed in any of the upstream side and the downstream side of the fan. The proportional valve serves to supply the fuel gas in an amount proportional to electric current charged thereto (proportional valve current). The proportional valve current is controlled such that fuel gas can be supplied in an amount according to the required combustion amount. However, in case the required combustion amount falls below the predetermined value, and the proportional valve current has fallen below the lower-limit current at which the proportional valve current can maintain the proportional characteristics of the amount of gas supply, the fuel gas can no longer be supplied in an amount according to the required combustion amount. Accordingly, even in an example in which the proportional valve is interposed in the gas supply passage, in a region in which the required combustion amount falls below the predetermined value, while maintaining the number of fan revolution at the lower-limit number of revolution and also while maintaining the proportional valve current at the lower-limit current, the opening degrees of the air inlet port and the gas outlet port are adjusted by the air adjusting valve and the gas adjusting valve. It is thus possible to supply the air and the fuel gas in amounts according to the required combustion amount below the predetermined value.

By the way, in the above-mentioned conventional example, it is for the purpose of disposing the gas adjusting valve in the neighborhood of the air adjusting valve driven by the common actuator that the gas outlet port is disposed at the end part, in the X-axis plus direction, of the gas tube. This arrangement, however, will give rise to the following disadvantage. In other words, the effect of the dynamic pressure of the air that flows in from the air inlet port positioned at the end part, in the X-axis plus direction, of the air tube will be extended to the gas outlet port. As a result, the amount of fuel gas supply is likely to become unstable.

PRIOR ART DOCUMENT

Patent Document

Patent Document 1: Japanese Translation of PCT International Application No. 2014-502337

SUMMARY OF THE INVENTION

Problems that the Invention is to Solve

In view of the above points, this invention has a problem of providing a premixing apparatus in which the effect of the dynamic pressure of the air that flows in from the air inlet port can be prevented from being extended to the gas outlet port.

Means of Solving the Problems

In order to solve the above problems, this invention is a premixing apparatus for mixing air with fuel gas, thereby supplying a burner with air-fuel mixture. The premixing apparatus comprises: a fan for supplying air; an air tube which is disposed on an upstream side or on a downstream side of the fan so that air flows therethrough. Suppose that: a longitudinal direction of the air tube is defined as an X-axis direction; that, in the X-axis direction, the direction looking toward an upstream side of air flow is defined as an X-axis plus direction; and that the direction looking toward a downstream side of the air flow is defined as an X-axis minus direction. Then the premixing apparatus further comprises: a gas tube which is connected to a downstream end of a gas supply passage for supplying the fuel gas and which is disposed inside the air tube; an air adjusting valve lying opposite to an air inlet port which is positioned at an end part, in the X-axis plus direction, of the air tube, in a manner to be movable back and forth in the X-axis direction to thereby vary an opening degree of the air inlet port; a gas adjusting valve lying opposite to a gas outlet port which is positioned at one end part, in the X-axis direction, of the gas tube, in a manner to be movable back and forth in the X-axis direction to thereby vary an opening degree of the gas outlet port; and a common actuator which drives in the X-axis direction both the air adjusting valve and the gas adjusting valve, characterized in: that the gas tube is of a bottomed shape with an end part thereof in the X-axis plus direction being closed; that, at an end part, in the X-axis minus direction, of the gas tube, there is disposed a valve seat for the gas adjusting valve, the valve seat having formed therein the gas outlet port, the gas adjusting valve being disposed inside the gas tube; and that a valve stem is disposed so as to be extended from the gas adjusting valve to penetrate through an end wall part, in the X-axis plus direction toward the actuator side, such that the gas adjusting valve is driven via the valve stem by the actuator in the X-axis direction.

According to this invention, since the gas outlet port is formed in the valve seat that is disposed at the end part, in the X-axis minus direction, of the gas tube, the effect of the dynamic pressure of the air that flows in from the air inlet port positioned at the end part in the X-axis plus direction of the air tube, will not be extended to the gas outlet port. The pressure acting on the gas outlet port will therefore become equal to the suction negative pressure corresponding to the number of fan revolution. Accordingly, it is possible to surely supply the burner with the amount of air and fuel gas according to the required combustion amount.

MODES FOR CARRYING OUT THE INVENTION

Figure 1:
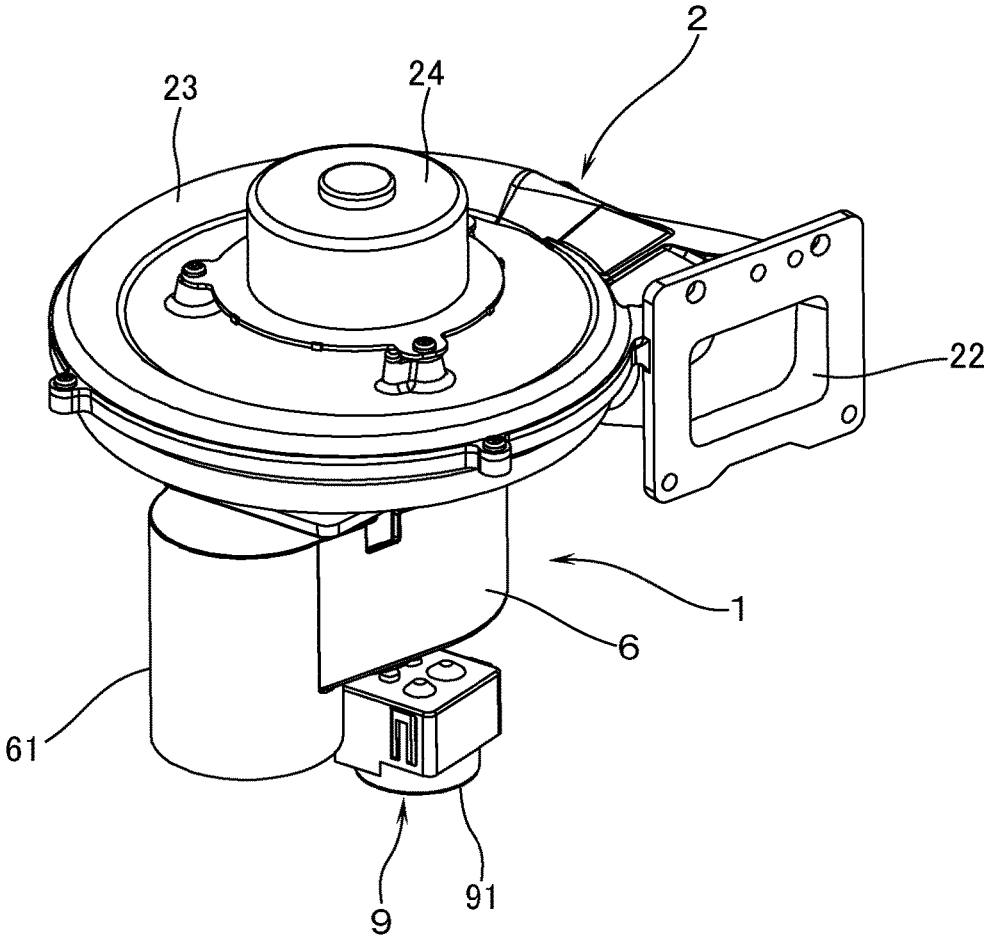
FIG. 1 is a perspective view to show a premixing apparatus according to an embodiment of this invention.
Figure 2:
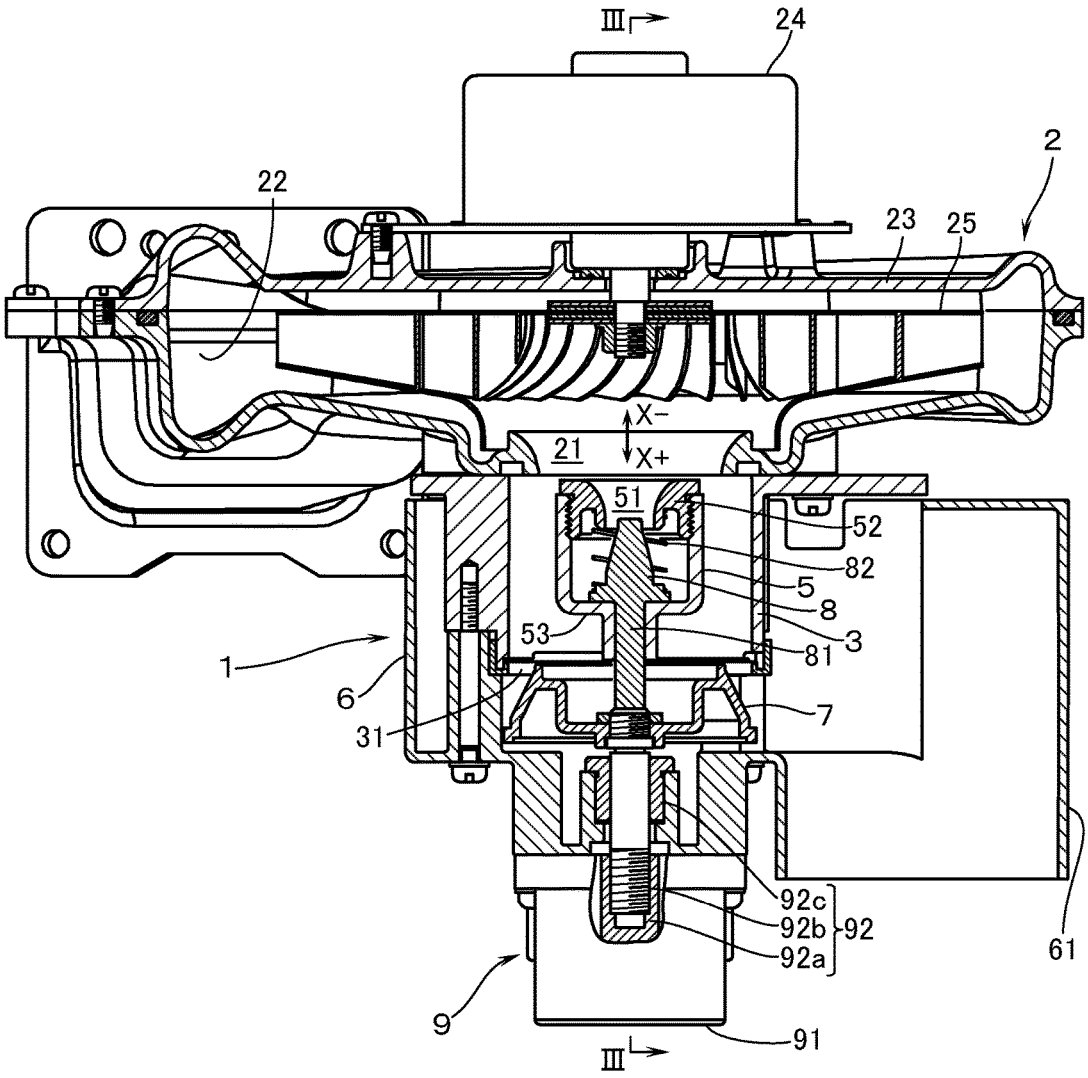
FIG. 2 is a sectional side view of the premixing apparatus according to the embodiment of this invention.
Figure 3:
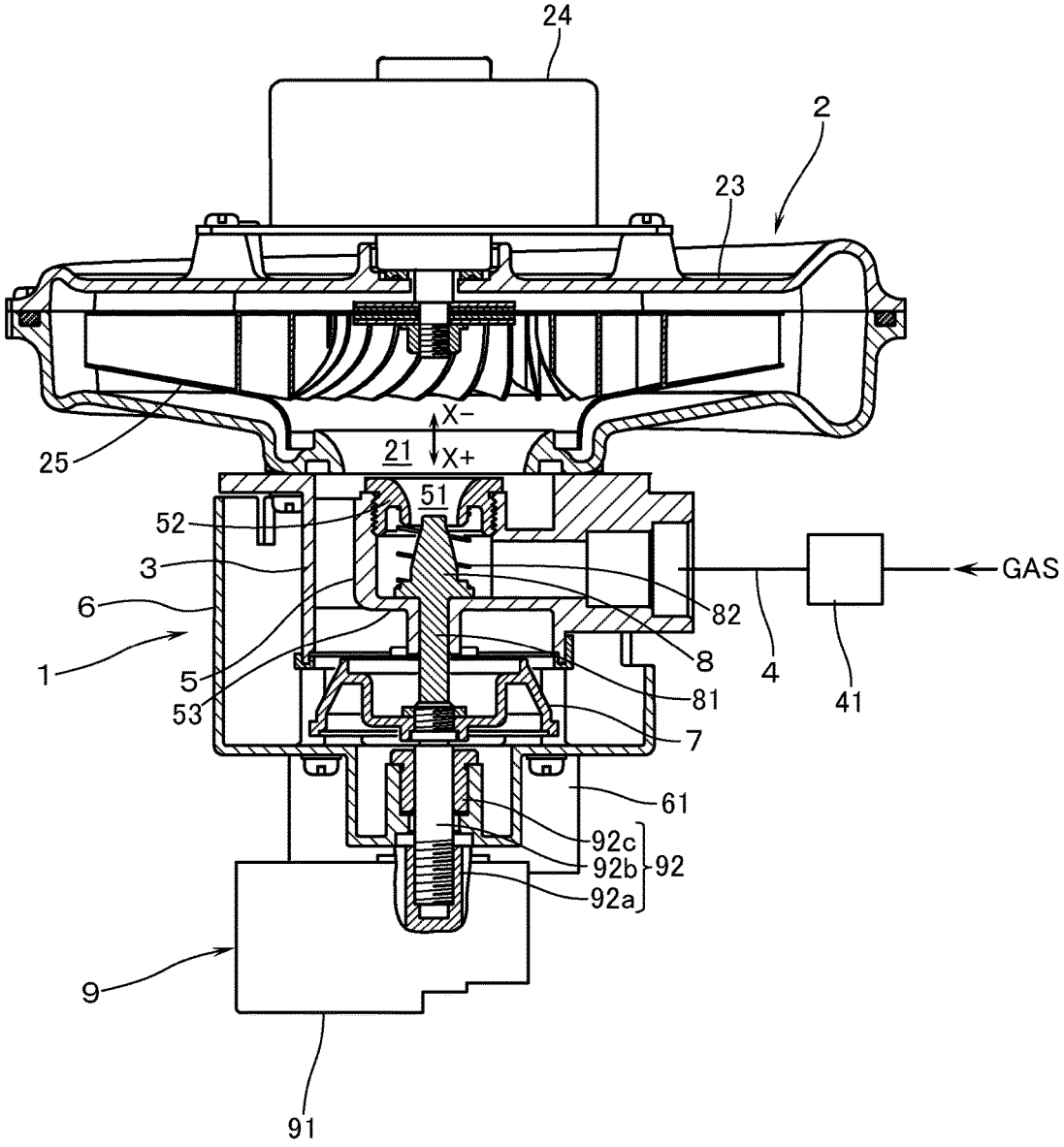
FIG. 3 is a sectional view taken along the line III-III in FIG. 2.

With reference to FIG. 1, reference numeral 1 denotes a premixing apparatus according to an embodiment of this invention, in which fuel gas is mixed with air to supply a burner (not illustrated) with air-fuel mixture. This premixing apparatus 1 is provided, as shown in FIGS. 2 and 3, with a fan 2 which supplies air, and an air tube 3 which is disposed on an upstream side of the fan 2 and through which the air passes. By the way, the fan 2 is constituted by a centrifugal type of fan in which an impeller 25 to be driven for rotation by a motor 24 is housed in a fan casing 23 which has a suction port 21 and an outlet port 22.

Suppose: that a longitudinal direction of the air tube 3 is defined as an X-axis direction; that, in the X-axis direction, the direction looking toward an upstream side of air flow is defined as an X-axis plus direction; and that the direction looking toward a downstream side of the air flow is defined as an X-axis minus direction. Then the premixing apparatus 1 is provided with a gas tube 5: which is connected to a downstream end of a gas supply passage 4 which supplies the fuel gas; which is disposed inside the air tube 3; and which is of a bottomed shape with an end part thereof in the X-axis plus direction being closed. Further, there is disposed an air supply case 6 which encloses the air tube 3 with a clearance therebetween. It is thus so arranged that the air flows from an air supply duct 61 disposed at one end of, and in communication with, the air supply case 6 to the air tube 3 through the internal space of the air supply case 6.

The premixing apparatus 1 is further provided with: an air adjusting valve 7 lying opposite to an air inlet port 31 which is positioned at an end part, in the X-axis plus direction, of the air tube 3, in a manner to be movable back and forth in the X-axis direction to thereby vary an opening degree of the air inlet port 31; a gas adjusting valve 8 lying opposite to a gas outlet port 51 which is positioned at an end part, in the X-axis minus direction, of the gas tube 5, in a manner to be movable back and forth in the X-axis direction to thereby vary the opening degree of the gas outlet port 51; and a common actuator 9 which drives in the X-axis direction both the air adjusting valve 7 and the gas adjusting valve 8.

In this embodiment, by providing the gas tube 5, at the end part in the X-axis minus direction, with a valve seat 52 for the gas adjusting valve 8, and by forming the gas outlet port 51 in this valve seat 52, the gas outlet port 51 is positioned at the end part, in the X-axis minus direction, of the gas tube 5 and also the gas adjusting valve 8 is disposed inside the gas tube 5. There is further disposed a valve stem 81 which extends from the gas adjusting valve 8 through an end wall part 53, in the X-axis plus direction, of the gas tube 5 to the actuator 9 side.

The actuator 9 is constituted by a motor 91, and a feed screw mechanism 92 on an output side. The feed screw mechanism 92 is constituted by: a nut 92*a* which is driven for rotation by a motor 91; a rod 92*b* which has a male-thread part to be brought into screwed engagement with the nut 92*a*; and a guide sleeve 92*c* which supports the rod 92*b* inserted therethrough in a manner to be movable in the X-axis direction while preventing the rod 92*b* from rotating. As a result of operation of the motor 91, the rod 92*b* moves back and forth in the X-axis direction. By fixing the air adjusting valve 7 to an end part, in the X-axis minus direction, of the rod 92*b*, the air adjusting valve 7 is arranged to move back and forth integrally with the rod 92*b*. In addition, there is disposed a spring 82 which pushes the gas adjusting valve 8 in the X-axis plus direction and, by means of the pushing force of this spring 82, the valve stem 81 is brought into contact with an end surface, in the X-axis minus direction, of the rod 92*b* so that the gas adjusting valve 8 can be moved back and forth in the X-axis direction integrally with the rod 92*b*.

Here, in a region in which the number of fan revolution according to the required combustion amount exceeds a lower-limit number of revolution at which the proportional characteristics of the amount of air blowing can be maintained, the number of fan revolution is controlled to supply the amounts of air and fuel gas corresponding to the required combustion amount. On the other hand, in a region in which the required combustion amount falls below the predetermined value corresponding to the lower-limit value of the number of fan revolution, in a state in which the number of fan revolution is maintained at the lower-limit number of revolution, the opening degrees of the air inlet port 31 and of the gas outlet port 51 are adjusted by the air adjusting valve 7 and the gas adjusting valve 8, respectively. In this manner, the air and the fuel gas according to the required combustion amount below the predetermined value are supplied.

Then, in this embodiment, since the gas outlet port 51 is positioned at the end part, in the X-axis minus direction, of the gas tube 5, the effect of the dynamic pressure of the air that flows in from the air inlet port 31 positioned at the end part, in the X-axis plus direction, of the air tube 3, will not be extended to the gas outlet port 51. The pressure that acts on the gas outlet port 51 will therefore become equal to the suction negative pressure corresponding to the number of fan revolution. Accordingly, in a region in which the required combustion amount exceeds the above-mentioned predetermined value, by controlling the number of fan revolution according to the required combustion amount, the air and the fuel gas according to the required combustion amount can surely be supplied to the burner.

Further, since the air adjusting valve 7 and the gas adjusting valve 8 are separate entities in this embodiment, at the time of converting the kind of gases to be used, it is sufficient to replace only the gas adjusting valve 8. The workability at the time of converting the kind of gases will thus be improved and, also, the number of replacement parts may economically be reduced.

Descriptions have so far been made of embodiments of this invention with reference to the drawings. However, this invention shall not be limited to the above. For example, in place of the zero governor 41, a proportional valve may be interposed in the gas supply passage 4. In this case, it is also possible to dispose the air tube 3 on the downstream side of the fan 2. Further, in the above-mentioned embodiment, the actuator 9 is constituted by the motor 91 and the feed screw mechanism 92, but other actuators such as of electromagnetic solenoid type and the like may be used.

Explanation of Reference Characters

| | | | |
|---|---|---|---|
| 1 | premixing apparatus | | |
| 2 | fan | 21 | suction port |
| 3 | air tube | 31 | air inlet port |
| 4 | gas supply passage | 5 | gas tube |
| 51 | gas outlet port | 52 | valve seat |
| 53 | end wall part | 7 | air adjusting valve |
| 8 | gas adjusting valve | 9 | actuator |

The invention claimed is:

1. A premixing apparatus for mixing air with fuel gas, thereby supplying a burner with air-fuel mixture, the premixing apparatus comprising:

a fan for supplying air;

an air tube which is disposed on an upstream side or on a downstream side of the fan so that air flows therethrough, wherein a longitudinal direction of the air tube is defined as an X-axis direction; in the X-axis direction, the direction looking toward an upstream side of air flow is defined as an X-axis plus direction; and the direction looking toward a downstream side of the air flow is defined as an X-axis minus direction;

a gas tube which is connected to a downstream end of a gas supply passage for supplying the fuel gas and which is disposed inside the air tube;

an air adjusting valve lying opposite to an air inlet port which is positioned at an end part, in the X-axis plus direction, of the air tube, in a manner to be linearly movable back and forth in the X-axis direction to thereby vary an opening degree of the air inlet port;

a gas adjusting valve lying opposite to a gas outlet port which is positioned at a first end part, in the X-axis minus direction, of the gas tube, in a manner to be linearly movable back and forth in the X-axis direction to thereby vary an opening degree of the gas outlet port; and a common actuator which drives in the X-axis direction both the air adjusting valve and the gas adjusting valve wherein the gas tube has an end wall part at a second end part thereof, opposite from the first end part in the X-axis plus direction, wherein at the first end part, in the X-axis minus direction, of the gas tube, there is disposed a valve seat for the gas adjusting valve, the valve seat having formed therein the gas outlet port, the gas adjusting valve being disposed inside the gas tube, and wherein a valve stem is disposed so as to be extended from the gas adjusting valve to penetrate through the end wall part, in the X-axis plus direction toward the actuator, such that the gas adjusting valve is driven via the valve stem by the actuator in the X-axis direction.

2. The premixing apparatus according to claim 1, the common actuator connects with direct contact both to the air adjusting valve and the gas adjusting valve.

* * * * *